US009617057B2

(12) United States Patent
Romanelli et al.

(10) Patent No.: US 9,617,057 B2
(45) Date of Patent: Apr. 11, 2017

(54) SUPPORT DEVICE

(71) Applicants: Peter Romanelli, West Islip, NY (US); Amer Klincevic, Commack, NY (US); Michael A. Treanor, North Babylon, NY (US)

(72) Inventors: Peter Romanelli, West Islip, NY (US); Amer Klincevic, Commack, NY (US); Michael A. Treanor, North Babylon, NY (US)

( * ) Notice: Subject to any disclaimer, the term of this patent is extended or adjusted under 35 U.S.C. 154(b) by 13 days.

(21) Appl. No.: 14/807,016

(22) Filed: Jul. 23, 2015

(65) Prior Publication Data

US 2017/0021989 A1 Jan. 26, 2017

(51) Int. Cl.

| | |
|---|---|
| ***B65D 1/42*** | (2006.01) |
| ***B65D 6/34*** | (2006.01) |
| ***B65D 8/08*** | (2006.01) |
| ***B65D 81/05*** | (2006.01) |
| ***B65D 5/49*** | (2006.01) |
| ***B65D 5/497*** | (2006.01) |
| ***B65D 5/498*** | (2006.01) |
| ***B65D 5/06*** | (2006.01) |
| ***B65D 5/50*** | (2006.01) |
| ***B65D 5/44*** | (2006.01) |
| ***B65D 85/36*** | (2006.01) |
| ***G09F 1/06*** | (2006.01) |

(52) U.S. Cl.

CPC ..... *B65D 81/05* (2013.01); *B65D 85/36* (2013.01); *B65D 2585/366* (2013.01)

(58) Field of Classification Search

CPC .. B65D 81/05; B65D 85/36; B65D 2585/366; B65D 5/5066; B65D 5/48028; B65D 5/48036; B65D 5/48044; B65D 5/48048; B65D 2571/00814; B65D 25/04; B65D 5/5023; G09F 1/06

USPC ..... 220/653

See application file for complete search history.

(56) References Cited

U.S. PATENT DOCUMENTS 1,733,663 A * 10/1929 Hale ..... B65D 85/327 206/521.3
2,788,596 A * 4/1957 Schwartz ..... G09F 1/06 248/459
2,797,855 A * 7/1957 Moore ..... B65D 5/48034 229/120.16

(Continued)

OTHER PUBLICATIONS

International Search Report and Written Opinion dated Sep. 16, 2016 received in International Application No. PCT/US16/43455.

*Primary Examiner* — Andrew T Kirsch

(74) *Attorney, Agent, or Firm* — Scully, Scott, Murphy & Presser, P.C.

(57) ABSTRACT

The presently disclosed support device includes an attachment portion that is configured to attach to an inner surface of a first wall of a box, a support portion having a proximal end rotatably connected to the attachment portion, the proximal end operably connected to the attachment portion in at least one section and the proximal end comprising a curved section, wherein the curved section comprises a support notch, and a securing portion having a proximal end rotatably connected to the attachment portion, wherein a distal end of the securing portion comprises a securing notch that is configured to engage with the support notch in the second position.

12 Claims, 10 Drawing Sheets

(56) References Cited

U.S. PATENT DOCUMENTS

| | | | | |
|---|---|---|---|---|
| 3,131,850 | A * | 5/1964 | Redpath | B65D 5/48024 229/120.16 |
| 5,542,540 | A | 8/1996 | Knapp et al. | |
| 5,740,957 | A * | 4/1998 | Wenkman | A47G 1/141 229/92.8 |

* cited by examiner

SUPPORT DEVICE

BACKGROUND OF THE DISCLOSURE

Typical boxes, including pizza boxes, which have a relatively large surface that is only supported around a periphery tend to deflect towards the interior of the box. This is an issue because this deflection can cause pressure, and in the case of pizza, contact the contents of the box undesirably.

Attempts to alleviate this issue have included the addition of a separate support inside the box to maintain the shape of the box and avoid or reduce deflection of the surface towards the interior of the box. This separate support has several shortcomings. One shortcoming is that users of the box often forget to add the separate support. Another shortcoming of the separate support is that it can shift position after being added because it is not secured to any portion of the box itself.

What is desired is a device and method for avoiding or reducing box deflection. Embodiments of the present disclosure provide methods that address the above and other issues.

SUMMARY OF THE DISCLOSURE

The present disclosure is directed to a support device. The support device includes an attachment portion that is configured to attach to an inner surface of a first wall of a box, a support portion having a proximal end rotatably connected to the attachment portion, the proximal end operably connected to the attachment portion in at least one section and the proximal end comprising a curved section, wherein the curved section comprises a support notch, and wherein the support portion has a first position that is substantially coplanar with the attachment portion and has a second position that is substantially perpendicular to the attachment portion and a securing portion having a proximal end rotatably connected to the attachment portion, wherein the securing portion has a first position that is substantially coplanar with the attachment portion and has a second position that is substantially perpendicular to the attachment portion, wherein a distal end of the securing portion comprises a securing notch that is configured to engage with the support notch in the second position.

BRIEF DESCRIPTION OF THE DRAWINGS

The present disclosure will be better understood by reference to the following drawings of which.

DETAILED DESCRIPTION OF THE DISCLOSURE

As used herein, the term "about" indicates that the value listed may be somewhat altered, as long as the alteration does not result in nonconformance of the process or structure to the illustrated embodiment. For example, for some elements the term "about" can refer to a variation of ±0.1%, for other elements, the term "about" can refer to a variation of ±1% or ±10%, or any point therein.

As used herein, the term "substantially" refers to the complete or nearly complete extent or degree of an action, characteristic, property, state, structure, item, or result. For example, an object that is "substantially" parallel would mean that the object is either completely parallel or nearly completely parallel. The exact allowable degree of deviation from absolute completeness may in some cases depend on the specific context. However, generally speaking the nearness of completion will be so as to have the same overall result as if absolute and total completion were obtained.

Figure 1:
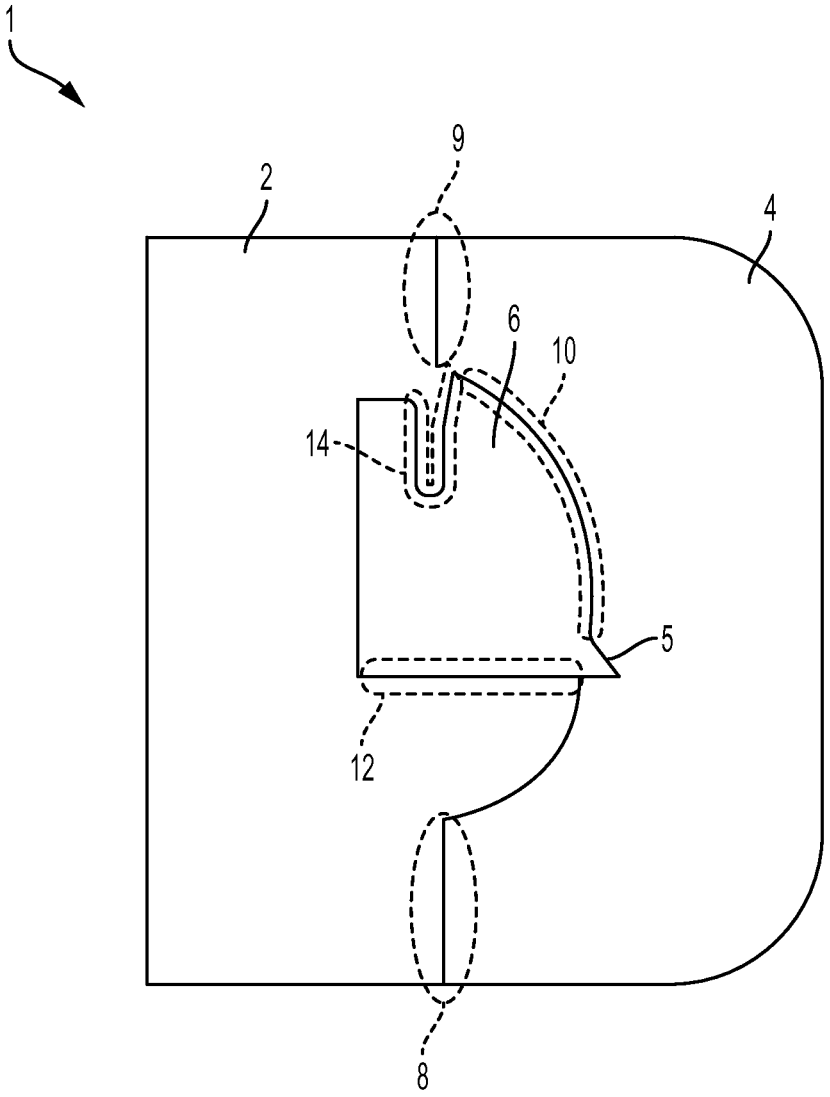
FIG. 1 is a plan view of an embodiment of the support device.

The support device 1 of the present disclosure is illustrated in FIG. 1. Support device 1 can be formed of a single piece of material, or of several pieces joined together. Support device 1 can be composed of any material suitable for bending and capable of supporting a load, such as paper and paper products, including cardboard, and can also be formed of plastics, metals, woods, any suitable man made material, any suitable synthetic material, and mixtures thereof. The dimensions of support device 1 can be modified based on the desired result and size of box the support device 1 is to be placed in. For example, support device 1 can be about four inches wide, about four inches long and about 0.2 inches thick. In other examples, each of these dimensions can be larger or smaller by up to 100% or more.

Support device 1 includes an attachment portion 2 that is configured to attach to an inner surface of a first wall of a box (not shown). This configuration of support device 1 being attached to an inner surface of a first wall of a box is further described and illustrated below. The whole surface or a portion of the surface of attachment portion 2 attaches to the inner surface through use of an adhesive, such as food based glue or the like or a mechanical attachment, such as a rivet or staple.

Rotatably connected to the attachment portion 2 is a support portion 4. The proximal end of the support portion 4 is rotatably connected to the attachment portion 2, with the proximal end operably connected to the attachment portion 2 in at least one section 8. In this embodiment there are two sections, 8 and 9, but in other embodiments one section could be included, or more than two sections. The proximal end of the support portion 4 also includes a curved section 10, with this curved section 10 comprising a support notch 5.

As shown in FIG. 1, the support portion 4 is in a first position that is substantially coplanar with the attachment portion 2. Support portion 4 also can be placed in a second position (not shown in FIG. 1 but shown below) that is substantially perpendicular to the attachment portion 2 by rotating support portion 4 relative to attachment portion 2 about sections 8 and 9.

Also included in support device 1 is a securing portion 6. Securing portion 6 has a proximal end 12 that is rotatably connected to the attachment portion 2. As seen in FIG. 1, proximal end 12 is a single section, but, in other embodiments, proximal end 12 can be two or more sections that are capable of being rotatably connected to the attachment portion 2. Securing portion 6 is shown in FIG. 1 in a first position that is substantially coplanar with attachment portion 2, securing portion 6 also has a second position (not shown in FIG. 1 but shown below) that is substantially perpendicular to the attachment portion 2.

A distal end of the securing portion 6, which opposes proximal end 12, comprises a securing notch 14 that is configured to engage the support notch 5 when the securing portion 6 and the support portion 4 are both in their second positions.

One or all of the surfaces shown in FIG. 1 can further include a coating of any suitable coating material. For example, suitable coating materials include one or more plastics such as polyethylene and polypropylene. Also, the surfaces on the opposing side of support device 1 can optionally include a coating.

Figure 2:
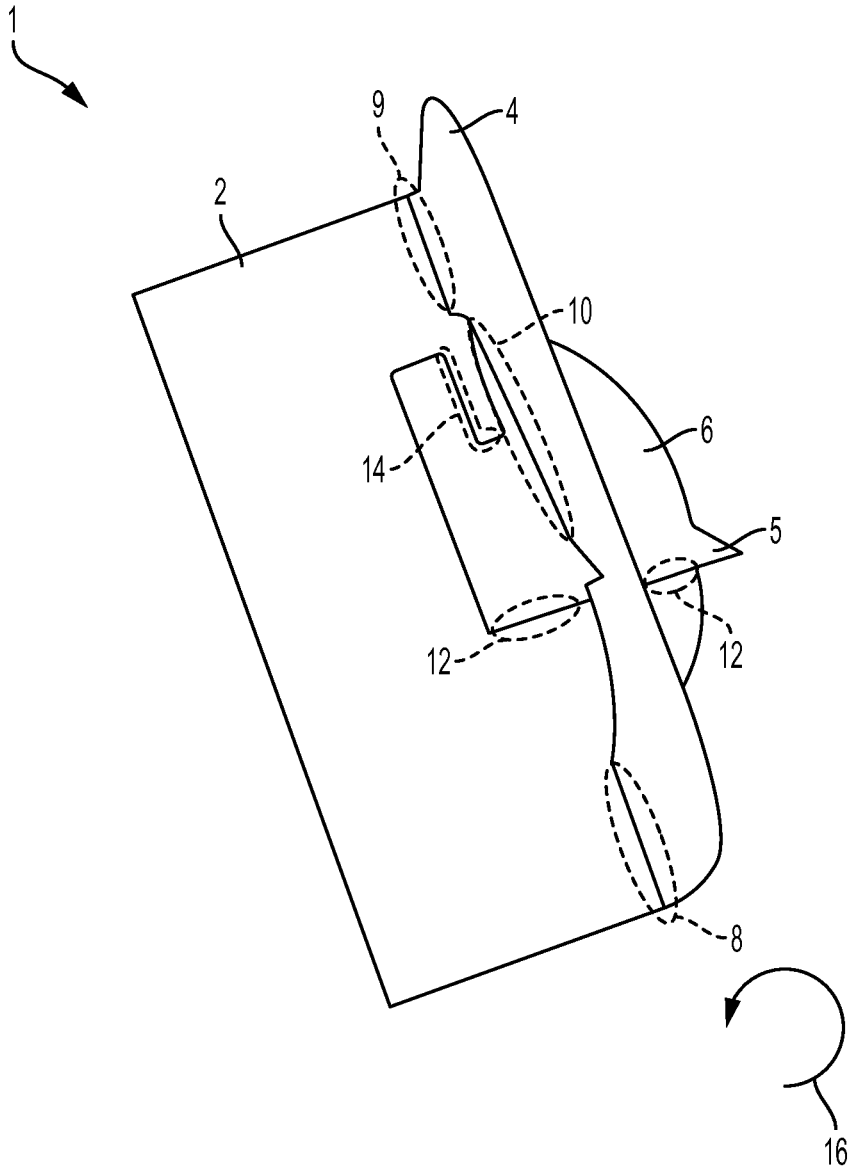
FIG. 2 is a perspective view of an embodiment of the support device.
Figure 3:
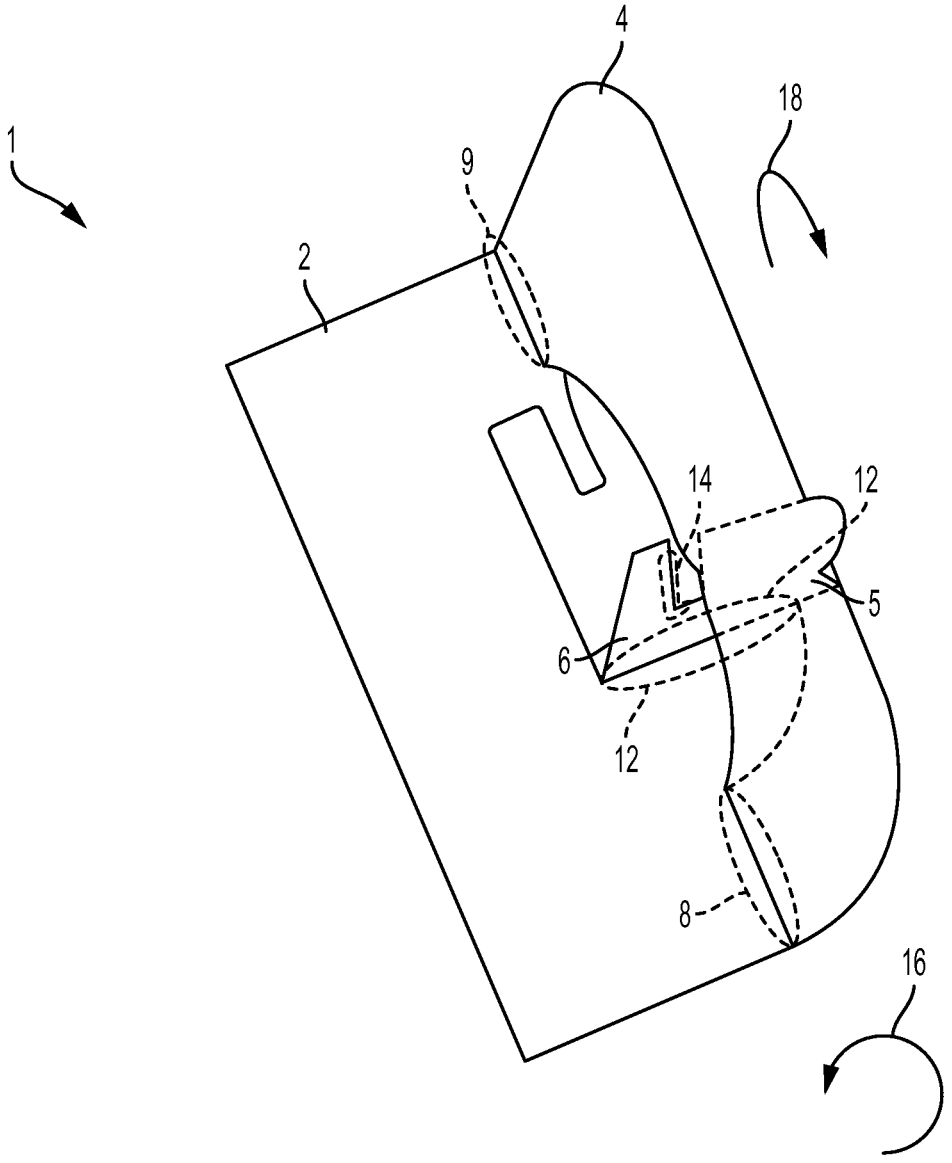
FIG. 3 is a perspective view of an embodiment of the support device.

Several views of support device 1 are discussed and illustrated below. FIG. 2 is a perspective view that illustrates support device 1 with support portion 4 rotated in the direction of arrow 16 and placed in support portion 4's second position. FIG. 3 is a perspective view that illustrates support device 1 with support portion 4 rotated in the direction of arrow 16, placing it in support portion 4's second position, and securing portion 6 rotated in the direction of arrow 18, placing it in securing portion 6's second position. In this configuration, support device 1 can be capable of supporting at least about 12 pounds of force applied from the direction of the attachment portion 2 for at least about 30 minutes.

Figure 4:
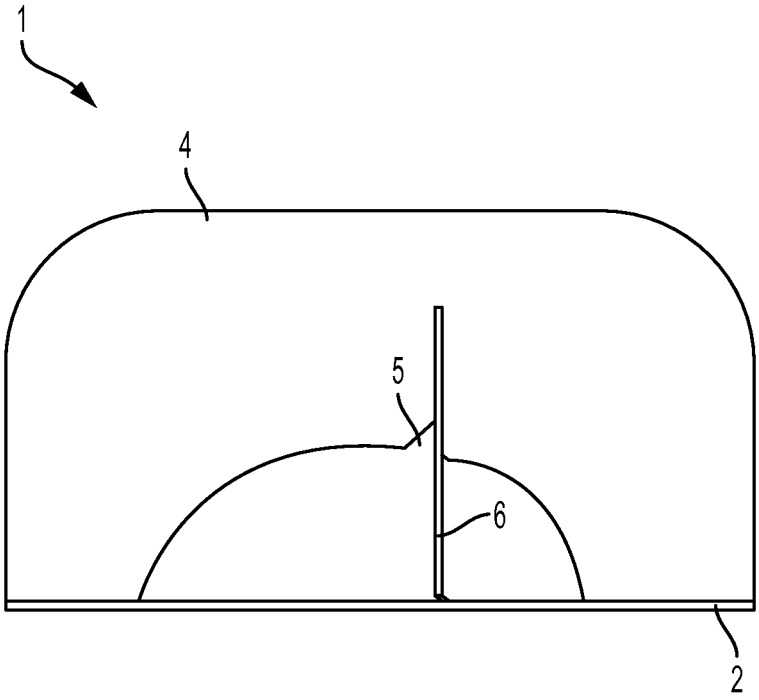
FIG. 4 is a left side view of an embodiment of the support device.
Figure 5:
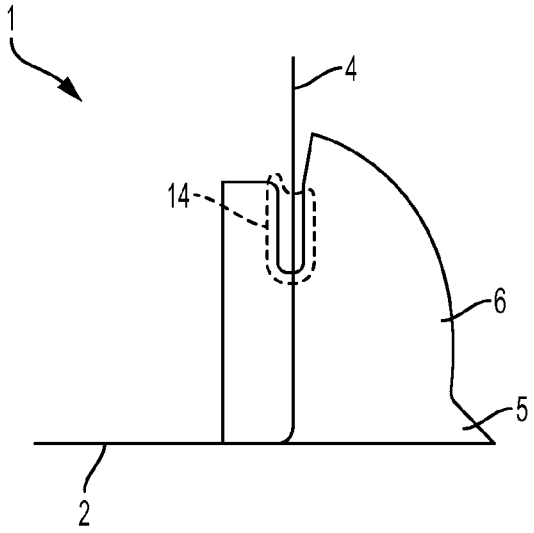
FIG. 5 is a front view of an embodiment of the support device.

FIG. 4 is a left side view of support device 1, with both support portion 4 and securing portion 6 rotated and placed in their second positions. FIG. 5 is a front view of support device 1, with both support portion 4 and securing portion 6 rotated and placed in their second positions.

Relative sizes and shapes of each of the attachment portion 2, support portion 4 and securing portion 6 can each be changed as desired and still maintain their function. For example, attachment portion 2 can be in the shape of a sporting good, such as a football, or in the shape of a lottery gaming ticket. Other non-limiting examples of the configuration of support device 1 are discussed below.

Figure 6:
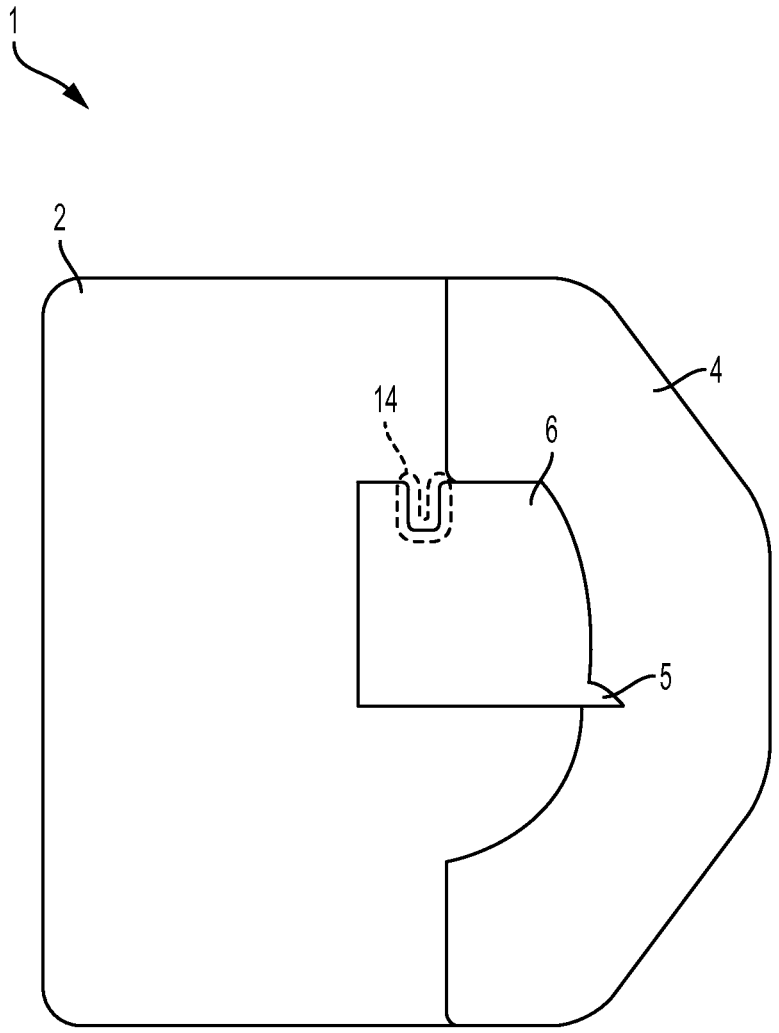
FIG. 6 is a plan view of another embodiment of the support device.
Figure 7:
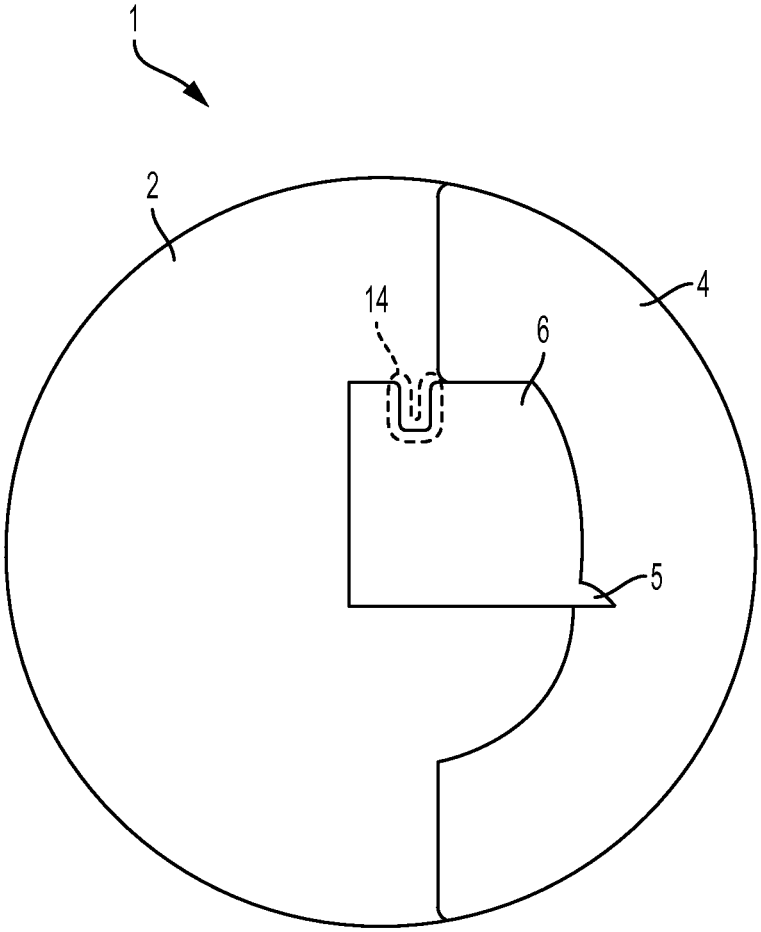
FIG. 7 is a plan view of another embodiment of the support device.
Figure 8:
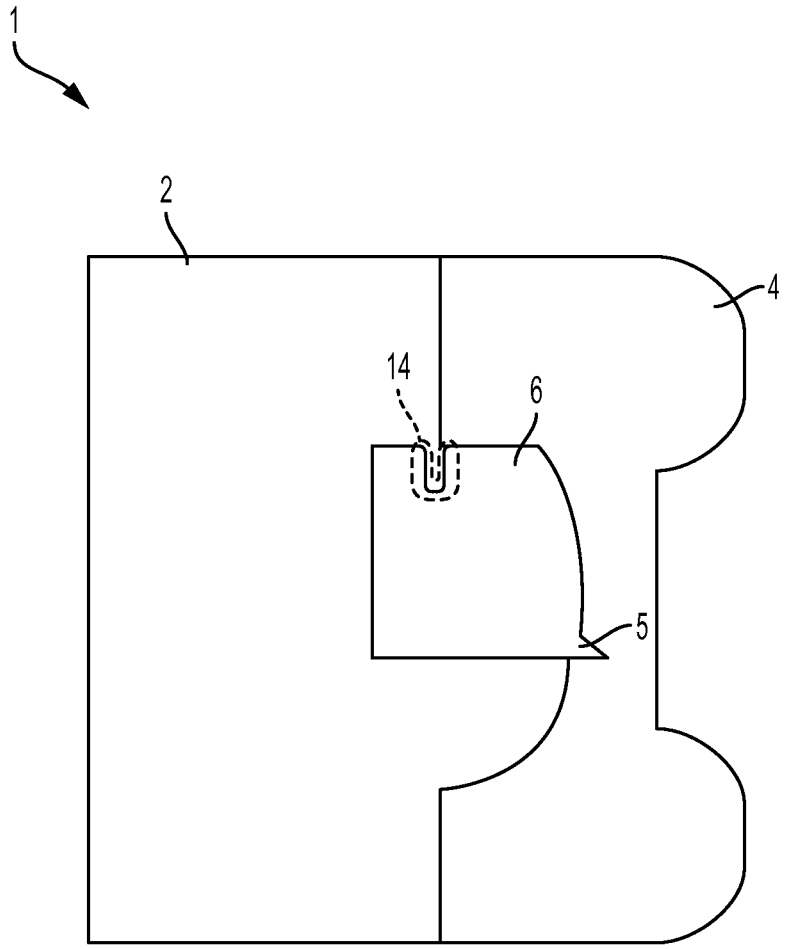
FIG. 8 is a plan view of another embodiment of the support device.

In one example, as shown in FIG. 6, support portion 4 can have a more angular profile as compared to the embodiment shown in FIG. 1. In another example, attachment portion 2 and support portion 4 can be shaped as shown in FIG. 7. In this embodiment of support device 1 shown in FIG. 7, both attachment portion 2 and support portion 4 can have a more rounded profile. In another example shown in FIG. 8, the outer profile of support portion 4 can include one or more protrusions, such as the two shown in FIG. 8. In other embodiments, support portion 4 can include one protrusion, three protrusions or more of varying shapes and profiles.

Figure 9:
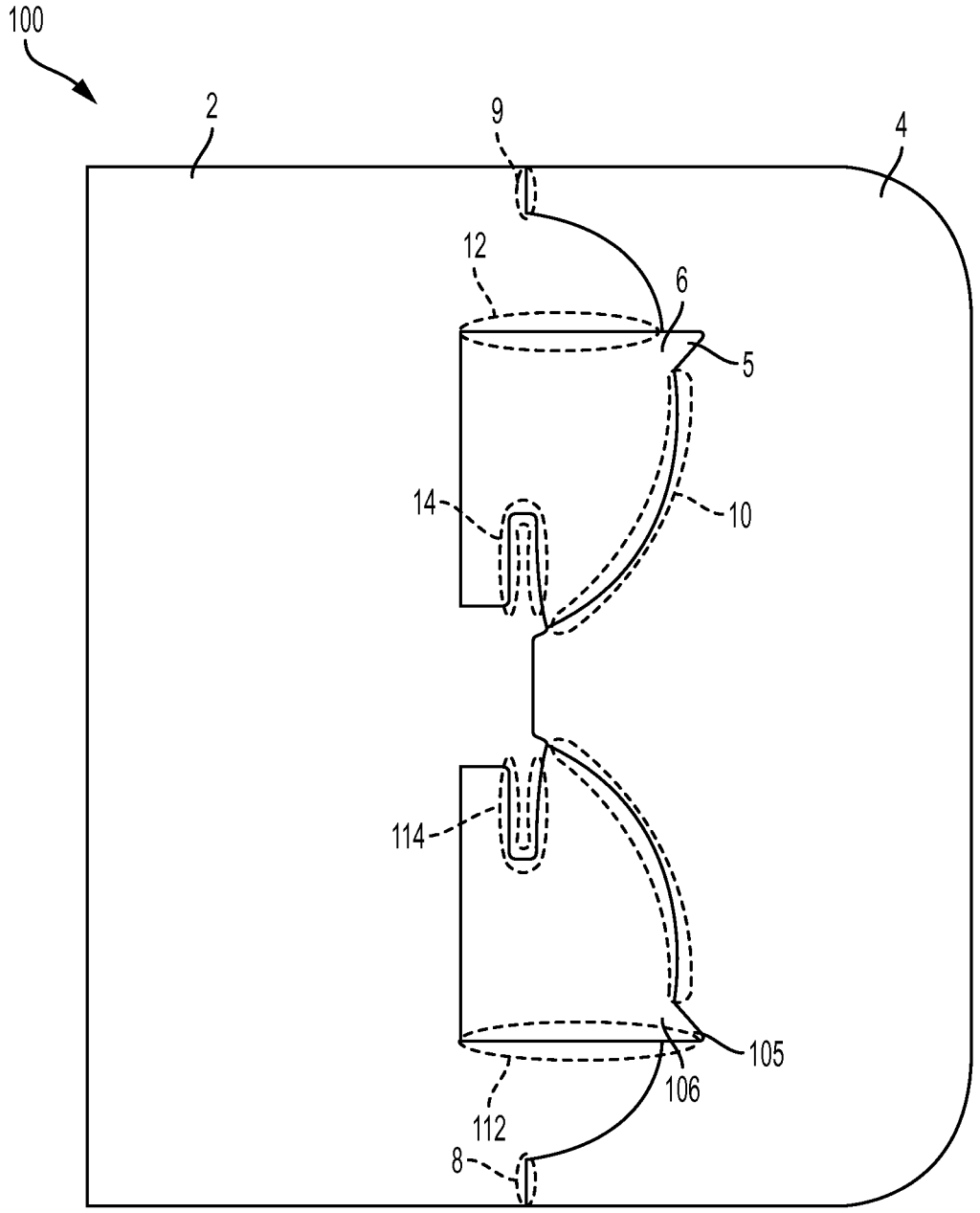
FIG. 9 is a plan view of another embodiment of the support device.
Figure 10:
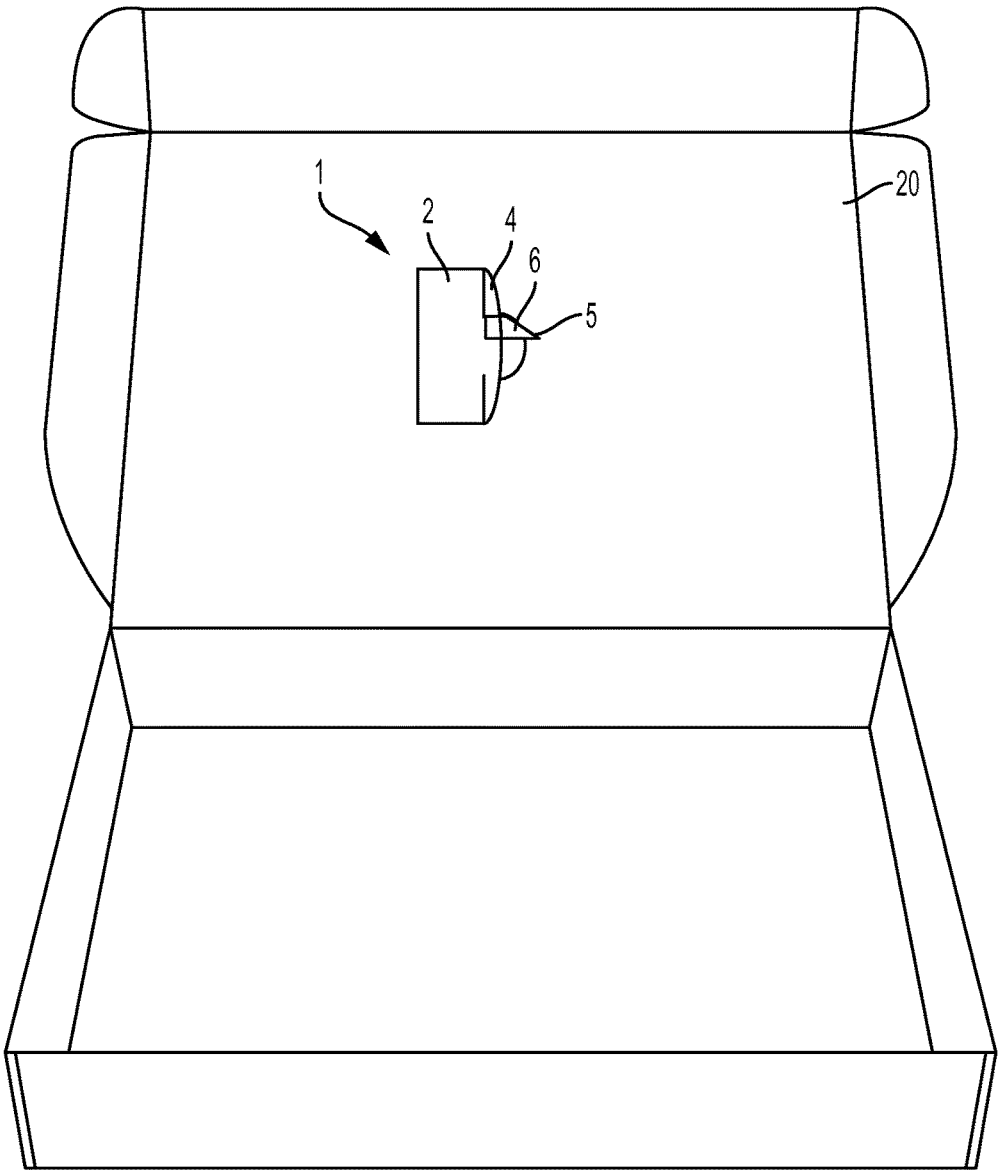
FIG. 10 is a perspective view of the support device attached to a box.

In another embodiment, a support device 100 can be configured as shown in FIG. 9. Support device 100 includes a second securing portion 106, which operates in a similar way to securing portion 6, but rotates about its proximal end 112 in the opposite direction as compared to how securing portion 6 rotates about its proximal end 12. In other embodiments the second securing portion can be oriented such that both securing portions rotate about their proximal ends in the same direction.

In support device 100, second securing portion 106 can be rotated about its proximal end 112 so that a second support notch 105 engages with a second securing notch 114 when support portion 4 is located in its second position.

The above examples illustrate just a few of the many sizes and shapes each of the components of the support device 1 can be. Other examples can include other shapes and sizes that are capable of performing the same or a similar function.

The methods and devices of the present disclosure will be better understood by reference to the following Examples, which are provided as exemplary of the disclosure and not by way of limitation.

Example 1

In the present example, the attachment portion 2 of support device 1 is attached to an inner surface of a first wall of a box 20. Although support device 1 can be attached to any box or container, in this example box 20 is a pizza box. Also in this example, attachment portion 2 is attached to the inner surface of a first wall of the box 20 by an adhesive. In this figure support device 1 is in the same configuration as what is shown and described in FIG. 3. In this figure support device 1 is orientated to substantially align with the outside of the box 20, but, in other examples support device 1 can be rotated at any angle on the first wall of the box 20.

To place support device 1 into this configuration, a user first rotates support portion 4 (in the direction of arrow 16 of FIG. 3) to place it in support portion 4's second position, and then rotates securing portion 6 (in the direction of arrow 18 of FIG. 3) to place it in securing portion 6's second position.

Once support device 1 is in this configuration and the box is closed, support device 1 substantially prevents downward deflection of the first wall of the box towards the opposite second wall of the box by contacting the second wall of the box with the distal end of the support portion 4. For varying box shapes and designs, the distance between the proximal end of support device 1 and the distal end of support device 1 can be configured to be about the distance between the first wall of the box and the second wall of the box once the box is closed.

The described embodiments and examples of the present disclosure are intended to be illustrative rather than restrictive, and are not intended to represent every embodiment or example of the present disclosure. While the fundamental novel features of the disclosure as applied to various specific embodiments thereof have been shown, described and pointed out, it will also be understood that various omissions, substitutions and changes in the form and details of the devices illustrated and in their operation, may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiment of the disclosure may be incorporated in any other disclosed or described or suggested form or embodiment as a general matter of design choice. Further, various modifications and variations can be made without departing from the spirit or scope of the disclosure as set forth in the following claims both literally and in equivalents recognized in law.

The invention claimed is:

1. A support device, the device comprising:

an attachment portion that is configured to attach to an inner surface of a first wall of a box;

a support portion having a proximal end rotatably connected to the attachment portion, the proximal end operably connected to the attachment portion in at least one section and the proximal end comprising a curved edge, wherein the curved edge comprises a support notch, and wherein the support portion has a first position that is substantially coplanar with the attachment portion and has a second position that is substantially perpendicular to the attachment portion; and a securing portion having a first section and a second section, the first section of the securing portion comprising a proximal end rotatably connected to the second section, wherein the first section of the securing portion has a first position that is substantially coplanar with the attachment portion and second section and the first section has a second position that is substantially perpendicular to the attachment portion and second section, wherein a distal end of the first section of the securing portion is curved and comprises a securing notch that is configured to engage with the support notch in the second position, wherein a distal end of the second section of the securing portion is curved and wherein the second section is configured to be coplanar with the attachment portion, wherein when the support portion is in the first position the support portion extends a horizontal distance further from the attachment portion than the second section and when the support portion is in the second position the second section extends a horizontal distance further from the attachment portion than the support portion.

2. The support device of claim 1, wherein the second position of the first section of the securing portion is substantially perpendicular to the support portion and substantially perpendicular to the attachment portion.

3. The support device of claim 1, wherein a distal end of the support portion in the second position is configured to contact an inner surface of a second wall of the box, and wherein the first wall is opposed to the second wall.

4. The support device of claim 3, wherein a distance between a distal end of the support portion and the proximal end of the support portion is configured to be about the distance between the first wall of the box and the second wall of the box.

5. The support device of claim 1, wherein the curved end of the first section of the securing portion and the curved end of the second section of the securing portion are adjacent the curved edge of the support portion when the first section of the securing portion and the curved end of the second section of the securing portion are in the first position.

6. The support device of claim 1, wherein the support notch extends from the proximal end of the support portion towards a distal end of the support portion.

7. The support device of claim 1, wherein the securing portion consists of one securing portion.

8. The support device of claim 1, wherein the support portion consists of one support portion.

9. The support device of claim 1, wherein the support portion is rotatably connected to the attachment portion in at most two sections.

10. The support device of claim 1, wherein the support portion comprises a second curved edge, which comprises a second support notch.

11. The support device of claim 10, further comprising a second securing portion having a proximal end rotatably connected to the attachment portion, wherein the second securing portion has a first position that is substantially coplanar with the attachment portion and has a second position that is substantially perpendicular to the attachment portion and substantially parallel to the securing portion, wherein a distal end of the second securing portion comprises a second securing notch that is configured to engage with the second support notch in the second position.

12. A box comprising:

at least two opposing walls; and a support device, the support device comprising:

an attachment portion that is configured to attach to an inner surface of a first wall of the box;

a support portion having a proximal end rotatably connected to the attachment portion, the proximal end operably connected to the attachment portion in at least one section and the proximal end comprising a curved edge, wherein the curved edge comprises a support notch, and wherein the support portion has a first position that is substantially coplanar with the attachment portion and has a second position that is substantially perpendicular to the attachment portion; and a securing portion having a proximal end rotatably connected to the attachment portion, wherein the securing portion has a first position that is substantially coplanar with the attachment portion and has a second position that is substantially perpendicular to the attachment portion, wherein a distal end of the securing portion comprises a securing notch that is configured to engage with the support notch in the second position, wherein when the support portion is in the first position the support portion extends a horizontal distance further from the attachment portion than the second section and when the support portion is in the second position the second section extends a horizontal distance further from the attachment portion than the support portion, and wherein a distal end of the support portion in the second position is configured to contact an inner surface of a second wall of the box, and wherein the first wall is opposed to the second wall, and wherein a distance between a distal end of the support portion and the proximal end of the support portion is configured to be about the distance between the first wall of the box and the second wall of the box.

* * * * *